US006794567B2

(12) United States Patent
Hughes et al.

(10) Patent No.: US 6,794,567 B2
(45) Date of Patent: Sep. 21, 2004

(54) AUDIO QUALITY BASED CULLING IN A PEER-TO-PEER DISTRIBUTION MODEL

(75) Inventors: David A. Hughes, New York, NY (US); Matthew A. Carpenter, New York, NY (US); Phuong L Nguyen, Wayne, NJ (US)

(73) Assignees: Sony Corporation, Tokyo (JP); Sony Music Entertainment, Inc., New York, NY (US)

( * ) Notice: Subject to any disclaimer, the term of this patent is extended or adjusted under 35 U.S.C. 154(b) by 64 days.

(21) Appl. No.: 10/216,526

(22) Filed: Aug. 9, 2002

(65) Prior Publication Data

US 2004/0025669 A1 Feb. 12, 2004

(51) Int. Cl.[7] ..... G10H 7/00; A63H 5/00; G04B 13/00

(52) U.S. Cl. ..... 84/609

(58) Field of Search ..... 84/600, 609

(56) References Cited

U.S. PATENT DOCUMENTS 5,758,027 A * 5/1998 Meyers et al. ..... 706/26
6,201,176 B1 * 3/2001 Yourlo ..... 84/609
6,372,974 B1 * 4/2002 Gross et al. ..... 84/609
6,657,117 B2 * 12/2003 Weare et al. ..... 84/668
2002/0129693 A1 * 9/2002 Wilks ..... 84/609

* cited by examiner

*Primary Examiner*—Jeffrey W Donels
(74) *Attorney, Agent, or Firm*—Mayer Fortkort & Williams, PC; Karin L. Williams, Esq.

(57) ABSTRACT

Electronic Music Distribution (EMD), wherein music stored as digital files is downloadable by end users from retail computer databases or from Peer to Peer "file sharing" databases such as Napster, has developed rapidly in the recent past as an alternative to the traditional distribution channels for recorded music. While EMD holds great promise as a distribution vehicle, certain limitations exist with regard to the capability of existing distribution models to classify or characterize the audio quality of the files available for download. This limitation is particularly acute in the Peer-to-Peer context where the downloadable database consists of files from a multiplicity of sources. The present invention utilizes an objective measure of audio quality that is, in one embodiment, presented as part of a response to a user or subscriber search query.

19 Claims, 4 Drawing Sheets

AUDIO QUALITY BASED CULLING IN A PEER-TO-PEER DISTRIBUTION MODEL

FIELD OF THE INVENTION

The present invention relates generally to the field of Electronic Music Distribution.

BACKGROUND OF THE INVENTION

Electronic Music Distribution (EMD), wherein music stored as digital files is downloadable by end users from retail computer databases or from Peer to Peer "file sharing" databases such as Napster, has developed rapidly in the recent past as an alternative to the traditional distribution channels for recorded music. While EMD holds great promise as a distribution vehicle, certain limitations exist with regard to the capability of existing distribution models to classify or characterize the audio quality of the files available for download. This limitation is particularly acute in the Peer to Peer context where the downloadable database consists of files from a multiplicity of sources.

In a Peer-to-Peer distribution model such as that used by Napster, for example, the database comprises digital music files submitted by database users and is searchable by song title, group, artist and genre. Each successful search yields at least one result and in most instances, several results for the same song or search request. Each data file corresponding to a song listing is detailed with certain attributes such as Frequency and Bitrate for example.

Frequency and file size are measures of how long it will take to download a specific audio file. The Frequency of an audio file corresponds to the number of sound samples per second in the archived audio file. The bitrate is a loose measure of the sound quality for the subject file wherein files with higher bitrate values have better sound quality overall.

Since the audio files in Peer-to-Peer file sharing databases come from a large number of disparate sources, there is a large variation in audio quality between audio files. Current file sharing applications offer no meaningful technique, other than bitrate values, as a guide to the audio quality of the file to be downloaded. Hence, a user, faced with multiple choices for each title searched, possesses no accurate measure by which to make an accurate choice of which file to download. Often, this dilemma results in the user having to first download a file, and then ascertain its audio quality by listening during playback. In many instances, a downloaded file may not meet a user's personal audio quality criteria, thus requiring the user to re-download the same title from a different "peer" in an effort to find the desired title with the desired audio quality. This trial and error approach is uncertain and time consuming. Moreover, it wastes bandwidth resources.

The present invention is therefore directed to the problem of providing an objective criteria by which a user can ascertain, prior to downloading, the audio quality of a file to be downloaded before the file is transferred from the Peer-to-Peer database to a user's storage and playback system.

SUMMARY OF THE INVENTION

The present invention solves this and other problems by providing a method by which the audio quality of archived audio files in an Electronic Music Distribution database can be ascertained prior to downloading, either by the user requesting an audio file, or a user uploading an audio file to a database.

According to one aspect of the present invention, a method for searching an electronic music distribution database includes four steps. First, a database search is executed in response to a search query. Second, audio files corresponding to the search query are identified. Third, an audio quality evaluation protocol is executed on the identified audio files to generate audio quality data corresponding to the files. Fourth, the identified audio files are displayed along with their corresponding audio quality data.

According to another aspect of the present invention, in the above method the evaluation protocol comprises the Perceptual Evaluation of Audio Quality (PEAQ) evaluation method.

According to another aspect of the present invention, in the above method the audio quality data includes the Objective Difference Grade variable.

According to another aspect of the invention, a method of evaluating audio files for archiving in a database includes three steps. First, at least one file is selected for evaluation. Second, an audio quality evaluation protocol is executed on the selected file to generate audio quality data corresponding to the audio file. Third, the selected audio file is archived along with the audio quality data.

According to another aspect of the present invention, in the above method, the evaluation protocol includes the PEAQ evaluation method.

According to another aspect of the present invention, in the above method, the audio quality data includes the Objective Difference Grade variable.

According to another aspect of the present invention, a device for evaluating the audio quality of an audio file includes a computer, which has an audio quality evaluation interface and the capability to communicate with an electronic music distribution database containing audio files. When instructed by a user, the interface performs an evaluation of one or more audio files in the database or in the P.C. of the subscriber uploading the file, and generates data corresponding to the audio quality of the files evaluated.

According to another aspect of the present invention, in the above device, the evaluation interface includes the capability to perform PEAQ measurements.

According to another aspect of the present invention, in the above device, the computer communicates with the database via a modem.

According to another aspect of the present invention, in the above device, the computer communicates with the database via a server.

According to another aspect of the present invention, in the above device, the data corresponding to the audio quality includes the Objective Difference Grade variable.

According to another aspect of the present invention, a system for retrieving audio files in an electronic music distribution database includes a server containing an archive of audio files and a computer, having an audio quality evaluation interface and the capability to communicate with the server. When instructed by a user of the computer, the server identifies one or more audio files. Once identified by the server, the files are then evaluated for audio quality by the evaluation interface. Based on this evaluation, the computer determines whether or not to retrieve the identified audio files.

According to another aspect of the present invention, in the above system, the audio quality interface includes the capability to perform PEAQ measurements.

According to another aspect of the present invention, in the above system, the instruction executed by the server includes a title, artist or genre search.

According to another aspect of the present invention, in the above system, the computer communicates with the server via modem.

According to another aspect of the present invention, in the above system, the computer communicates with the server via a Point-of-Presence server.

DETAILED DESCRIPTION

Figure 1:
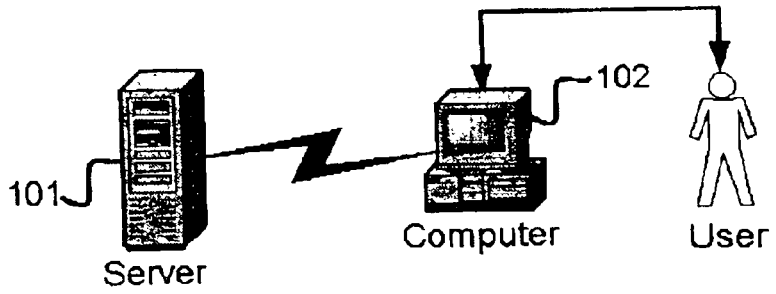
FIG. 1 depicts a user interface of a conventional EMD database.

It is worthy to note that any reference herein to "one embodiment" or "an embodiment" means that a particular feature, structure, or characteristic described in connection with the embodiment is included in at least one embodiment of the invention. The appearances of the phrase "in one embodiment" are not necessarily all referring to the same embodiment.

The embodiments of the invention include inter alia a method and apparatus for evaluating the audio quality of audio files from an electronic music distribution database and generating an objective measure of the audio quality of archived audio files. In one embodiment of the present invention, audio quality of stored audio files is determined using the standardized methodology known as the Perceptual Evaluation of Audio Quality (PEAQ).

Overview of PEAQ

A perceptual measurement method called PEAQ provides a method for an objective measurement of audio quality. PEAQ includes measures of nonlinear distortion, linear distortion, harmonic structure, distance to masked threshold and changes in modulation. These variables are mapped by a neural network to a single measure of audio quality. One objective quality variable generated by a PEAQ evaluation is the Objective Difference Grade (ODG) variable.

PEAQ—the ITU Standard for Objective Measurement of Audio Quality

The limitations imposed by available bandwidth can affect the quality and responsiveness of digital audio communication systems. The need to conserve bandwidth has led to developments in the compression of the audio data to be transmitted. Various encoding methods remove both redundancy and perceptual irrelevancy in the audio signal so that the bit rate required to encode the signal is significantly reduced. These compression algorithms take into account knowledge of human auditory perception, and typically achieve a reduced bit rate by ignoring audio information that is not likely to be heard by most listeners. A psychoacoustic model is used to predict how this information is masked by louder audio content adjacent in time and frequency. The degree of compression permitted by a codec (coder/decoder) depends, to some extent, on the sophistication of the model employed.

The perceived quality of decoded audio may suffer when a compression algorithm pushes the limit with respect to bit rate reduction. The performance typically varies with different types of audio content, and some implementations may be more successful than others in the use of psychoacoustic knowledge. Subjective tests are most reliable for assessing the quality of decoded audio. However, the expense and time to conduct such tests often prohibit their use. Therefore, a fast and reliable method for objective measurement of perceived audio quality has been developed.

The International Telecommunications Union (ITU) describes in detail a standard method for measuring the quality of wide bandwidth audio (ITU Recommendation BS.1387, "Method for Objective Measurements of Perceived Audio Quality," which is hereby incorporated by reference as if repeated herein in its entirety, including any figures). The method is the result of a joint effort among laboratories in Canada, The Netherlands, France, and Germany. The acronym for the measurement model is PEAQ (Perceptual Evaluation of Audio Quality).

The psychoacoustic model employed in the method produces a number of variables based on comparisons between a reference signal and the same signal processed by a particular device such as a codec. These variables are used to predict the subjective quality rating that would be assigned to the processed signal if a formal listening test were conducted. The objective quality measurement was calibrated using results from a number of listening tests conducted using a standard methodology also recommended by the ITU.

Figure 4:
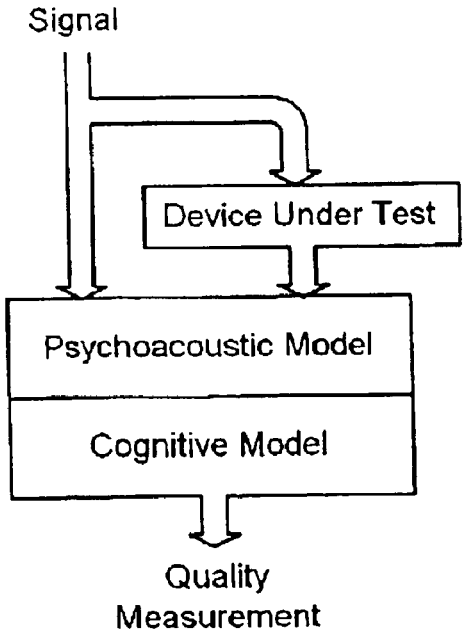
FIG. 4 depicts a block diagram of a PEAQ process.

The ITU recommendation describes two variations of the method. The Basic Version is intended to be fast enough for real-time monitoring, while the Advanced Version is computationally more demanding but is expected to give slightly more reliable results. The high level structure of both the Basic Version and the Advanced Version is shown in FIG. 4. As in the listening tests, the quality of the test signal is measured relative to the reference signal. Each signal is transformed into a time-frequency representation by the psychoacoustic model. Then a task-specific model of auditory cognition reduces these data to a number of scalar variables, some of which are mapped to the desired quality measurement.

The psychoacoustic model in the Basic Version uses a Discrete Fourier Transform (DFT) to transform the signal to a time-frequency representation, while the Advanced Version uses both a DFT and a filter bank. The data from the DFT is mapped from the frequency scale to a pitch scale, the psychoacoustic equivalent of frequency. For the filter bank, the frequency to pitch mapping is implicitly taken into account by the bandwidths and spacing of the bandpass filters. The input energy is spread over adjacent pitch regions as a function of the level of the input.

Simultaneous masking is achieved via the masked threshold concept as well as by comparison of internal representations. The approach based on the masked threshold concept calculates a level dependent masked threshold for the reference signal at any pitch value using a predefined psychophysical masking function. Additional energy in the test signal is deemed to be audible if the representation of that energy exceeds the masked threshold. In the approach based on the comparison of internal representations, the energies of both the test and the reference signal are spread to adjacent pitch regions in order to obtain excitation patterns, and are non-linearly compressed to approximate loudness. Non-simultaneous forward masking is implemented by smearing the excitation patterns over time prior to compression. The difference between the resulting internal representations models the energy in the test signal that is not masked by the reference audio content.

The cognitive model compares the internal representations and calculates scalar variables that summarize psychoacoustic activity over time. Important information for making the quality measurement is derived from the differences between the frequency and pitch domain representations of the reference and test signals. In the frequency domain, the spectral bandwidths of both signals are measured and the harmonic structure in the error is determined. In the pitch domain, error measures are derived from the excitation envelope modulations, the excitation magnitudes, and the excitation derived from the error signal calculated in the frequency domain. The quality measurement is based on eleven variables for the Basic Version, and on five variables for the Advanced Version.

Figure 5:
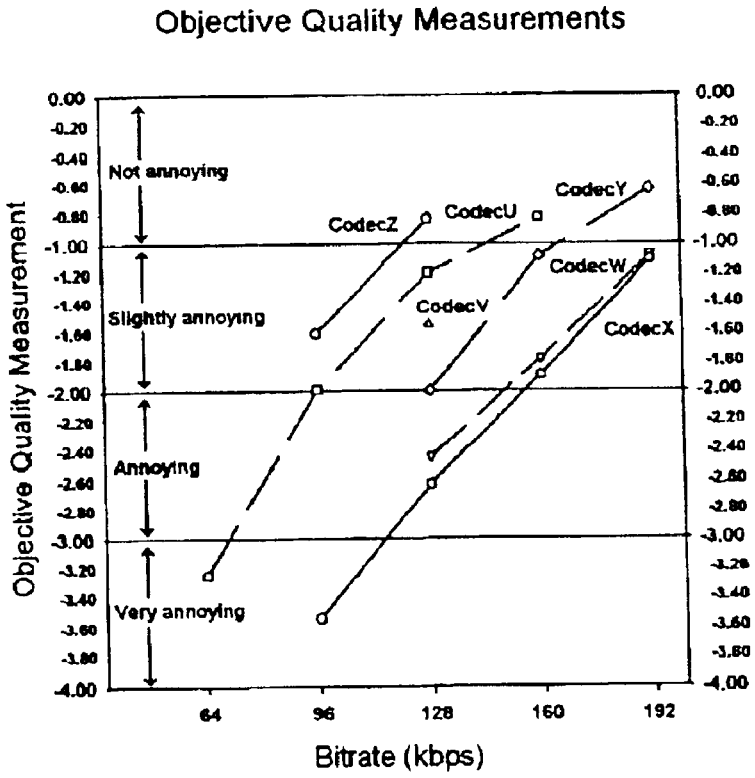
FIG. 5 depicts objective quality measurements from a PEAQ process.
Figure 6:
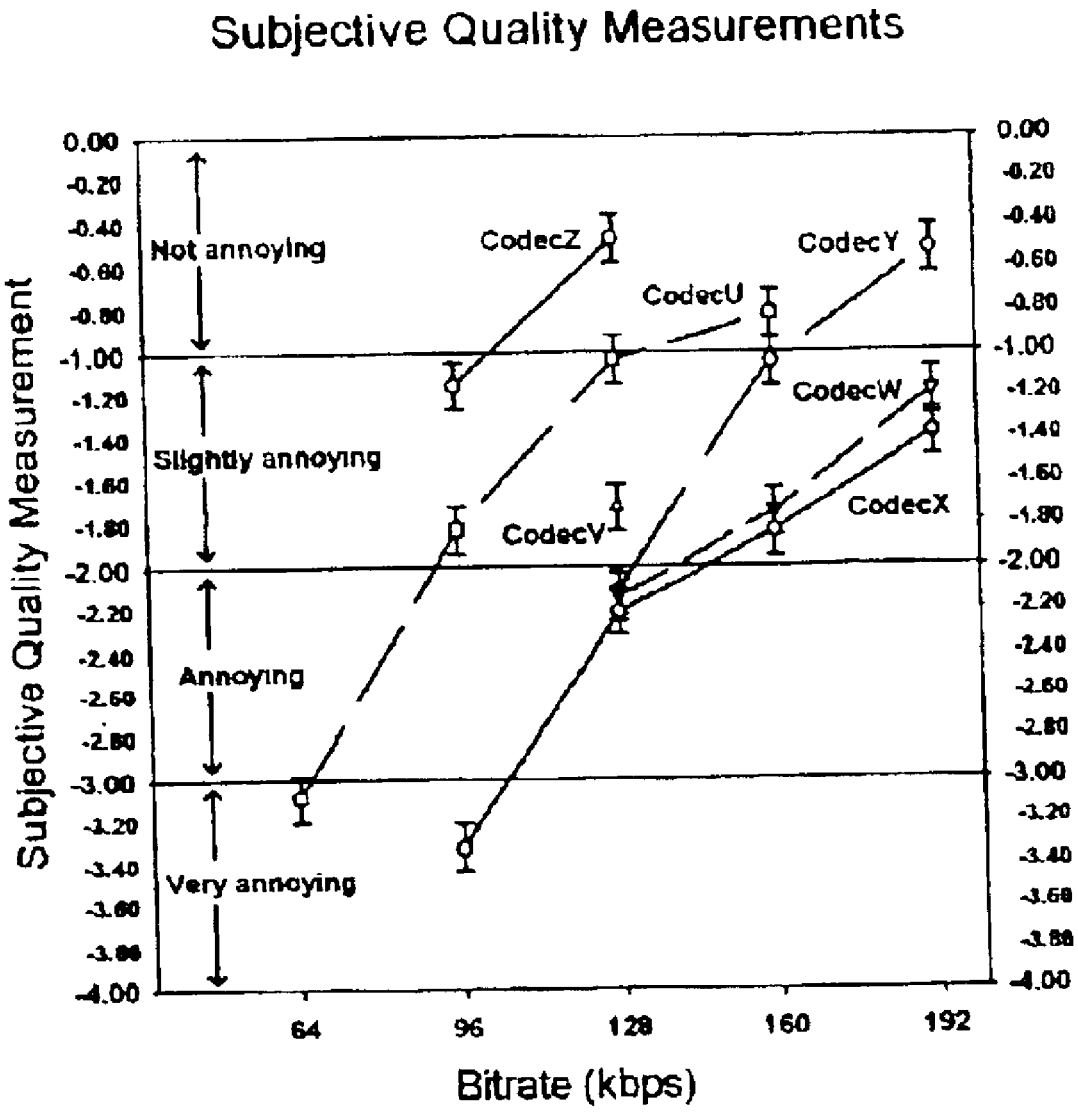
FIG. 6 depicts subjective quality measurements from a PEAQ process.

An example of the performance of this method may be seen in FIGS. 5–6 where objective codec quality measurements are compared with corresponding subjective ratings.

U.S. Pat. No. 5,758,027 discloses a method and apparatus for performing a PEAQ analysis, and is hereby incorporated by reference as if repeated herein in its entirety including the drawings.

Exemplary Embodiment

An exemplary embodiment of one aspect of the present invention incorporates PEAQ as a measurement tool in the electronic distribution of audio files. In current electronic music distribution systems, such as Napster and as shown in FIG. 1, a user or subscriber connects to a server 101 that contains a database of audio files via a personal computer 102 or similar terminal. In response to a search query by the user or subscriber, the server 101 searches the database and lists "hits" or audio files corresponding to the search query initiated by the subscriber.

It is quite common in Peer-to-Peer (P2 P) distribution systems, such as Napster for example, for a search query to yield multiple hits corresponding to the user request. These hits, however, do not all possess the same audio quality since they were sourced from different subscribers to the distribution databases with correspondingly different quality levels of equipment. Thus, for any given query a subscriber is faced with many examples corresponding to the user's query and no real tool to determine the quality of the audio file represented by each hit.

Typically, listings are detailed with attributes such as frequency and bit rate. The frequency of an audio file corresponds to the number of sound samples per second in the archived audio file and is a measure of how long it will take to download the specific audio file in question. The bitrate, on the other hand, is a loose measure of the sound quality for the subject file wherein files with higher bitrate values have better sound quality overall.

The present invention utilizes an objective measure of audio quality that is, in one embodiment, presented as part of a response to a user or subscriber search query.

Figure 2:
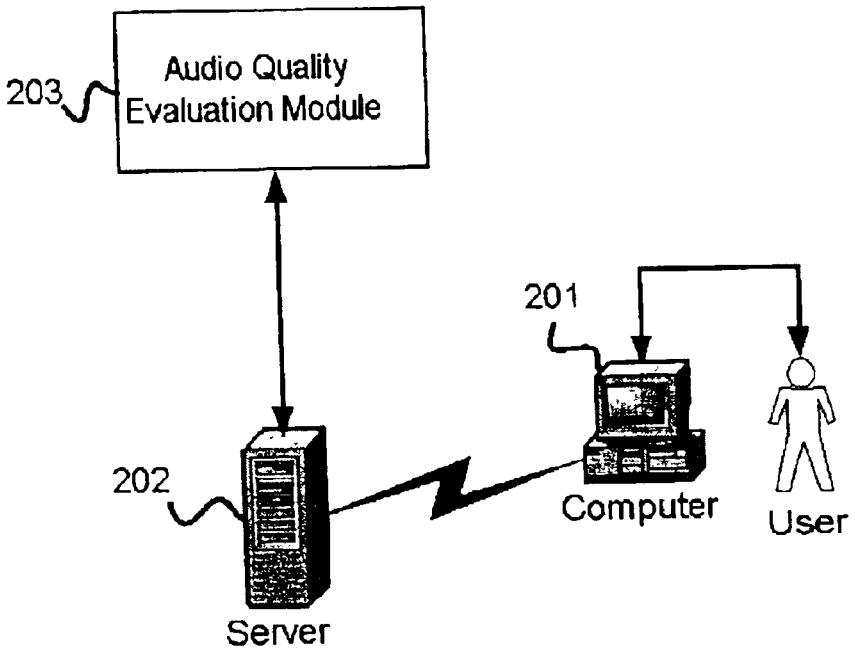
FIG. 2 depicts a block diagram of an exemplary embodiment of the present invention.

In particular, and with reference to FIG. 2, one embodiment of the present invention comprises a computer 201 in communication with a server 202 via communication means such as a modem or other conventional communication means (not shown). The server 202 comprises a database of archived audio files and includes an audio quality evaluation module 203. In response to a search query-initiated by a user or subscriber via computer 201 and communicated to server 202, audio quality evaluation module 203 performs an evaluation of all archived audio files corresponding to the user search query and the server 202 in turn, displays the archived audio files corresponding to the user search query along with the results of the evaluation step performed by the audio quality evaluation module 203. The search query can contain a broad spectrum of information or may contain no more than a desired song title, artists name or genre. The user can also designate a minimum threshold level of audio quality desired, thereby eliminating from display results that do not meet the minimum designated audio quality.

The audio quality evaluation module preferably evaluates the audio quality of the results of the search query using the PEAQ evaluation protocol. In this manner, the subscriber or user is presented with a listing of all downloadable audio files corresponding to the search query along with an objective measure of the audio quality of the archived audio files corresponding to the search query. While PEAQ is a preferred audio evaluation protocol in the present invention, it should be clear to one skilled in the art that alternative audio quality evaluation protocols and methods can be substituted for PEAQ as an alternative audio quality evaluation tool.

Figure 3:
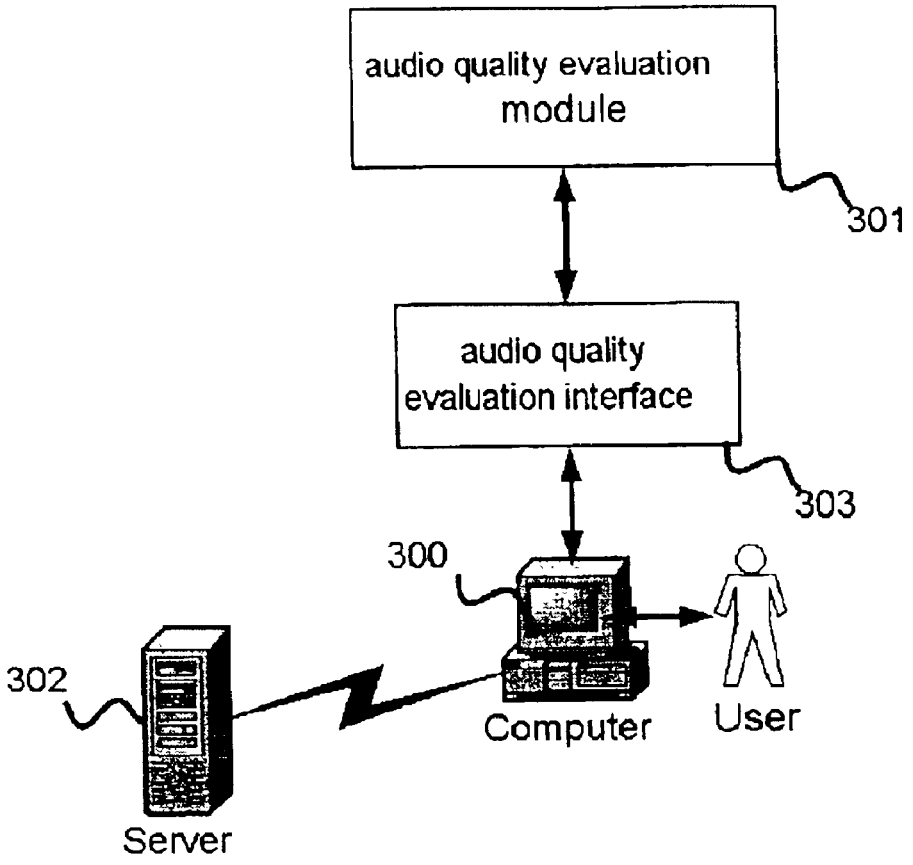
FIG. 3 depicts a block diagram of a second exemplary embodiment of the present invention.

In second embodiment of the present invention and with reference to FIG. 3, the present invention comprises a computer 300 operated by a user or subscriber to an EMD. The computer 300 comprises an audio quality evaluation module 301 that interfaces with the computer via an audio quality evaluation interface 303. The computer 300, audio quality evaluation module 301 and the audio quality evaluation interface 303 are in communication with a server 302 via communication means such as a modem or other conventional communicating means (not shown). In response to a search query initiated by the user, server 302 displays all archived digital audio files corresponding to the search query. The search query can contain a broad spectrum of information or may contain no more than a desired song title, artists name or genre. The user can also designate a minimum threshold level of audio quality desired, thereby eliminating from display results that do not meet the minimum designated audio quality.

Once results corresponding to a search query are displayed, the user can select an archived audio file corresponding to the search query in conventional fashion. However, prior to storage of the archived audio file in computer 300, Audio quality evaluation module 301, in conjunction with audio quality evaluation interface 303 perform an audio quality evaluation of the digital audio file being downloaded, and display the result of the evaluation to the user as a preview of the audio quality of the file being downloaded. This procedure allows the user to objectively evaluate the audio quality of the digital audio file selected for downloading and reject the selection if it does not meet the user's preferences.

All the features disclosed in this specification (including any accompanying claims, abstract and drawings), and/or all of the steps or any method or process so disclosed may be combined in any combination, except combinations where at least some of the features and or steps are mutually exclusive. Each feature disclosed in this specification (including any accompanying claims, abstract, and drawings) may be replaced by alternative features serving the same, equivalent or similar purpose, unless expressly stated otherwise. Thus unless expressly stated otherwise, each feature disclosed is one example only of a generic series of equivalent or similar features.

Moreover, although various embodiments are specifically illustrated and described herein, it will be appreciated that modifications and variations of the invention are covered by the above teachings and within the purview of the appended claims without departing from the scope of the invention.

What is claimed is:

1. A method for searching an electronic music distribution database comprising:

executing a database search in response to a search query;

identifying audio files corresponding to said search query;

executing an audio quality evaluation protocol on said audio flies;

generating audio quality data corresponding to said audio flies; and displaying said audio files and said corresponding audio quality data, wherein said audio quality evaluation protocol comprises the Perceptual Evaluation of Audio Quality (PEAO) method.

2. The method according to claim 1, wherein said audio quality data comprises the Objective Difference Grade (ODG) variable.

3. A method for evaluating audio files for archiving in a database comprising:

receiving an identification of audio files corresponding to a search query initiated by a user;

selecting, by the user, at least one of the identified audio files for evaluation;

executing, subsequent to the step of selecting, an audio quality evaluation protocol on said selected at least one identified audio file;

generating audio quality data corresponding to said at least one identified audio file; and archiving said at least one identified audio file and said corresponding audio quality data.

4. The method according to claim 3, wherein said evaluation protocol comprises the PEAQ perceptual method.

5. The method according to claim 3, wherein said audio quality data comprises the Objective Difference Grade variable.

6. A device for evaluating the audio quality of an audio file comprising:

a computer having an audio quality evaluation interface, an audio quality evaluation module and a communicator for communicating with an electronic music distribution database, said database comprising a plurality of digital audio files, wherein said computer is configured to: (1) communicate with said database via said communicator, (2) to receive through the communicator an identification of audio files corresponding to a search query initiated by a user, (3) to receive an indication of at least one user-selected audio file, and to (4) perform an evaluation of the audio quality of the at least one user-selected audio file using the audio evaluation module to generate data corresponding to audio quality.

7. The device according to claim 6, wherein said audio quality evaluation interface comprises an evaluator for performing PEAQ evaluations.

8. The device according to claim 6, wherein said communicator comprises a modem.

9. The device according to claim 6, wherein said data corresponding to said audio quality comprises the Objective Difference Grade variable.

10. The device according to claim 9, wherein said communicator composes a server.

11. A system for retrieving audio files in an electronic music database comprising:

a server including a searchable database storing a plurality of digital audio files; and a computer including an audio quality evaluation module to evaluate an audio quality value of a designated audio file and a communicator to communicate with said server, wherein in response to at least one instruction from said computer via said communicator, (1) said server searches said plurality of digital audio files to identify any of said plurality of audio files corresponding to said instruction, (2) said evaluation module determines an audio quality value of any identified audio file, and (3) said computer determines whether said identified audio file corresponds to a minimum threshold level of audio quality specified in said instruction.

12. The system according to claim 11, wherein said audio quality evaluation module performs a Perceptual Evaluation of Audio Quality calculation.

13. The system according to claim 11, wherein said at least one instruction comprises at least one of a title, artist and genre search.

14. The system according to claim 11, wherein said communicator comprises a modem.

15. The system according to claim 11, wherein said communicator comprises a Point-Of-Presence (POP) server.

16. The system according to claim 11, wherein said communicator comprises a computer network.

17. The system according to claim 11, wherein said communicator comprises the Internet.

18. The system according to claim 11, wherein said audio quality is referenced in terms of the Objective Difference Grade variable.

19. The method according to claim 3 further comprising the step of:

downloading the at least one identified audio file selected by the user, prior to the step of executing an audio quality evaluation protocol.

* * * * *

UNITED STATES PATENT AND TRADEMARK OFFICE

CERTIFICATE OF CORRECTION

PATENT NO. : 6,794,567 B2
DATED : September 21, 2004
INVENTOR(S) : David A. Hughes et al.

It is certified that error appears in the above-identified patent and that said Letters Patent is hereby corrected as shown below:

Column 5,
Line 35, change "(P2 P) to -- (P2P) --.

Column 6,
Lines 4 and 33, before "name", change "artists" to -- artist's --.
Line 41, after "computer 300,", change "Audio" to -- audio --.
Line 43, change first word "perform" to -- performs --.
Line 44, change "display" to -- displays --.

Column 7,
Line 7, after "audio", change "flies" to -- files --.
Line 9, change first word "flies" to -- files --.

Column 8,
Line 9, correct dependency from "claim 9" to -- claim 6 --.
Line 10, change "composes" to -- comprises --.

Signed and Sealed this

First Day of March, 2005

JON W. DUDAS
*Director of the United States Patent and Trademark Office*